US008875992B2

(12) United States Patent
Bradley

(10) Patent No.: US 8,875,992 B2
(45) Date of Patent: Nov. 4, 2014

(54) AUTOMATED TELLER MACHINES, METHODS OF MAKING AND USING AUTOMATED TELLER MACHINES

(76) Inventor: Anthony R. Bradley, McDonough, GA (US)

( * ) Notice: Subject to any disclaimer, the term of this patent is extended or adjusted under 35 U.S.C. 154(b) by 196 days.

(21) Appl. No.: 13/483,802

(22) Filed: May 30, 2012

(65) Prior Publication Data

US 2012/0306331 A1 Dec. 6, 2012

Related U.S. Application Data

(60) Provisional application No. 61/491,293, filed on May 30, 2011.

(51) Int. Cl.
*G07F 19/00* (2006.01)

(52) U.S. Cl.
CPC ..... *G07F 19/205* (2013.01); *G07F 19/207* (2013.01); *Y10S 902/08* (2013.01)
USPC ..... 235/379; 902/8

(58) Field of Classification Search
CPC ..... G07F 19/20; G07F 19/201; G07F 19/205; G07F 19/207; G07F 19/209; G06Q 20/1085
USPC ..... 235/379; 902/8, 14, 30
See application file for complete search history.

(56) References Cited

U.S. PATENT DOCUMENTS

2009/0289105 A1* 11/2009 Block et al. ..... 235/379
2012/0038774 A1* 2/2012 Reimann et al. ..... 348/150

* cited by examiner

*Primary Examiner* — Kristy A Haupt
(74) *Attorney, Agent, or Firm* — Withers & Keys, LLC

(57) ABSTRACT

Automated teller machines (ATMs) and ATM components are disclosed. Methods of making and using ATMs and ATM components are also disclosed.

20 Claims, 12 Drawing Sheets

AUTOMATED TELLER MACHINES, METHODS OF MAKING AND USING AUTOMATED TELLER MACHINES

CROSS-REFERENCE TO RELATED APPLICATIONS

This patent application claims the benefit of priority to U.S. Provisional Patent Application Ser. No. 61/491,293 filed on May 30, 2011 and entitled "AUTOMATED TELLER MACHINES, METHODS OF MAKING AND USING AUTOMATED TELLER MACHINES", the subject matter of which is hereby incorporated by reference in its entirety.

FIELD OF THE INVENTION

The present invention relates to automated teller machines (ATMs) and ATM components, methods of making ATMs and ATM components, and methods of using ATMs and ATM components.

BACKGROUND OF THE INVENTION

FIG. 1 provides a view of an automated teller machine (ATM) of the prior art, namely, ATM 10, having the following components: a screen display 11 for viewing by a user of the ATM; a check insert slot 12 for depositing checks; a keypad 13 for inputting information for use by the ATM; a money-distributing component 14 for providing cash to the user; an ATM card swiping component 15; a receipt-providing slot 16 for providing a printed receipt for the user; a deposit slot 17 for depositing cash or checks from the user; a camera location 18 positioned to take video of the user during a transaction with the ATM; a cover member 19 extending a length above screen display 11 and between check insert slot 12 and throat 20; speaker slots 21; and outer housing surface 22 extending around, between and surrounding the above-mentioned ATM components.

ATM 10 has one or more shortcomings relating to camera location 18. In particular, camera location 18 does not provide a view of a user when the user is standing in front of the ATM. Camera location 18 provides a view of a user sitting in a vehicle or a user standing back a distance from the ATM or a user standing so that the user's face is parallel to camera location 18, but does not provide a view of a user's face when the user is standing in front of the ATM, especially a user that is more than about 4-5 feet tall.

Further, when a camera (not shown) is positioned at camera location 18 within ATM 10, the camera is typically mounted onto a movable assembly positioned within ATM 10 (i.e., a movable assembly 54 shown in FIG. 6 is an example of such a movable assembly that moves from an operating position as shown in FIG. 6 to a maintenance position (i.e., see FIG. 5 which shows the inside of an ATM with movable assembly 54 moved into the maintenance position)). In order to adjust a camera setting (e.g., focus), one has to make an adjustment to the camera settings while the movable assembly (with mounted camera) is in the maintenance position, slide the camera and movable assembly back into the operating position, and check the camera new settings. If further adjustments to the camera settings are needed, the above procedure is repeated (i.e., adjustments to the camera settings cannot be made while the camera is positioned in its operating position).

What is needed in the art is an automated teller machine (ATM) that has one or more of the following features: (i) at least one camera positioned along an outer housing surface so as to provide a better view of a user of the ATM, (ii) a camera position so that camera setting adjustments (e.g., focus) may be more easily made, and (iii) at least one removable camera lens cover positioned along an outer housing surface of the ATM so as to be removable from a front position relative to the outer housing surface.

SUMMARY OF THE INVENTION

The present invention is directed to automated teller machines (ATMs) and various components of ATMs. The ATMs of the present invention provide one or more of the following features: (i) at least one camera positioned along an outer housing surface so as to provide a better view of a user of the ATM, (ii) a camera position so that setting adjustments may be more easily made, and (iii) at least one removable camera lens cover positioned along an outer housing surface of the ATM so as to be removable from a front position relative to the outer housing surface.

According to one exemplary embodiment of the present invention, the automated teller machine of the present invention is directed to an automated teller machine comprising a housing structure comprising at least one outer housing surface; and at least one camera lens cover positioned along the at least one outer housing surface, wherein the at least one camera lens cover is removable from the at least one outer housing surface from a front side of the at least one outer housing surface.

In another embodiment of the present invention, the automated teller machine of the present invention is directed to an automated teller machine comprising a housing structure comprising an outer housing surface; a screen display viewable to a user and positioned along the outer housing surface; a keypad for inputting one or more letters or numbers and positioned along the outer housing surface; a money-distributing component positioned along the outer housing surface; a check insert slot positioned along the outer housing surface; a throat positioned along the outer housing surface; speaker slots positioned along the outer housing surface; a cover member extending a length above the screen display and between the check insert slot and the throat; and at least one camera lens cover positioned along the outer housing surface, wherein the at least one camera lens cover is positioned along an upper portion of the screen display or above the screen display.

The present invention is further directed to an externally mountable camera housing suitable for use with an ATM. In one exemplary embodiment, the externally mountable camera housing comprises a front surface having an aperture therethrough; a rear surface opposite the front surface; at least one side surface extending from the front surface to the rear surface; a connecting edge extending along the front surface, the rear surface and the at least one side surface, the connecting edge being configured to attach to an outer housing surface of an ATM; an intermediate wall extending perpendicular to the connecting edge and parallel with the front surface, wherein the intermediate wall comprises a camera mounting slot therein; camera lens cover channels along opposite sides of the aperture; and a removable camera lens cover sized to be positionable within the camera lens cover channels. In some embodiments, the at least one side surface extending from the front surface to the rear surface comprises three side surfaces, and an upper side surface of the three side surfaces has a length that is greater than a length of a lower side surface of the three side surfaces.

The present invention is also directed to a camera lens cover that is positionable along an outer housing surface of an ATM, wherein the camera lens cover is removable from the outer housing surface of the ATM from a front side of the outer housing surface of the ATM. In some embodiments, the camera lens cover comprises threads along an outer periphery of the camera lens cover, wherein the threads are engagable with another set of threads within the outer housing surface of the ATM.

The present invention is even further directed to methods of making and using any of the disclosed ATMs and the various components of the disclosed ATMs. In one exemplary embodiment, the method of making an ATM component comprises forming an externally mountable camera housing suitable for use with an ATM, wherein the externally mountable camera housing comprises a front surface having an aperture therethrough; a rear surface opposite the front surface; at least one side surface extending from the front surface to the rear surface; a connecting edge extending along the front surface, the rear surface and the at least one side surface, the connecting edge being configured to attach to an outer housing surface of an ATM; and an intermediate wall extending perpendicular to the connecting edge and parallel with the front surface, wherein the intermediate wall comprises a camera mounting slot therein. In some embodiments, the forming step comprises an injection molding step, and the resulting externally mountable camera housing comprises three side surfaces, and an upper side surface of the three side surfaces has a length that is greater than a length of a lower side surface of the three side surfaces.

In another exemplary embodiment, the method of making an ATM component comprises forming a camera lens cover that is positionable along an outer housing surface of an ATM, wherein the camera lens cover is removable from the outer housing surface of the ATM from a front side of the outer housing surface of the ATM. In some embodiments, the forming step comprises thermoforming a camera lens cover; and machining threads along an outer periphery of the camera lens cover, wherein the threads are engagable with another set of threads within an outer housing surface of the ATM.

The present invention is even further directed to methods of adjusting a camera setting of a camera within an ATM. In one exemplary embodiment, the method of adjusting a camera setting of a camera within an ATM comprises adjusting a camera setting of the camera while the camera is in its operating position. For example, the method of adjusting a camera setting of a camera within an ATM may comprise focusing the camera while the camera is in its operating position.

These and other features and advantages of the present invention will become apparent after a review of the following detailed description of the disclosed embodiments and the appended claims.

BRIEF DESCRIPTION OF THE FIGURES

The present invention is further described with reference to the appended figures, wherein.

DETAILED DESCRIPTION OF THE INVENTION

Figure 2:
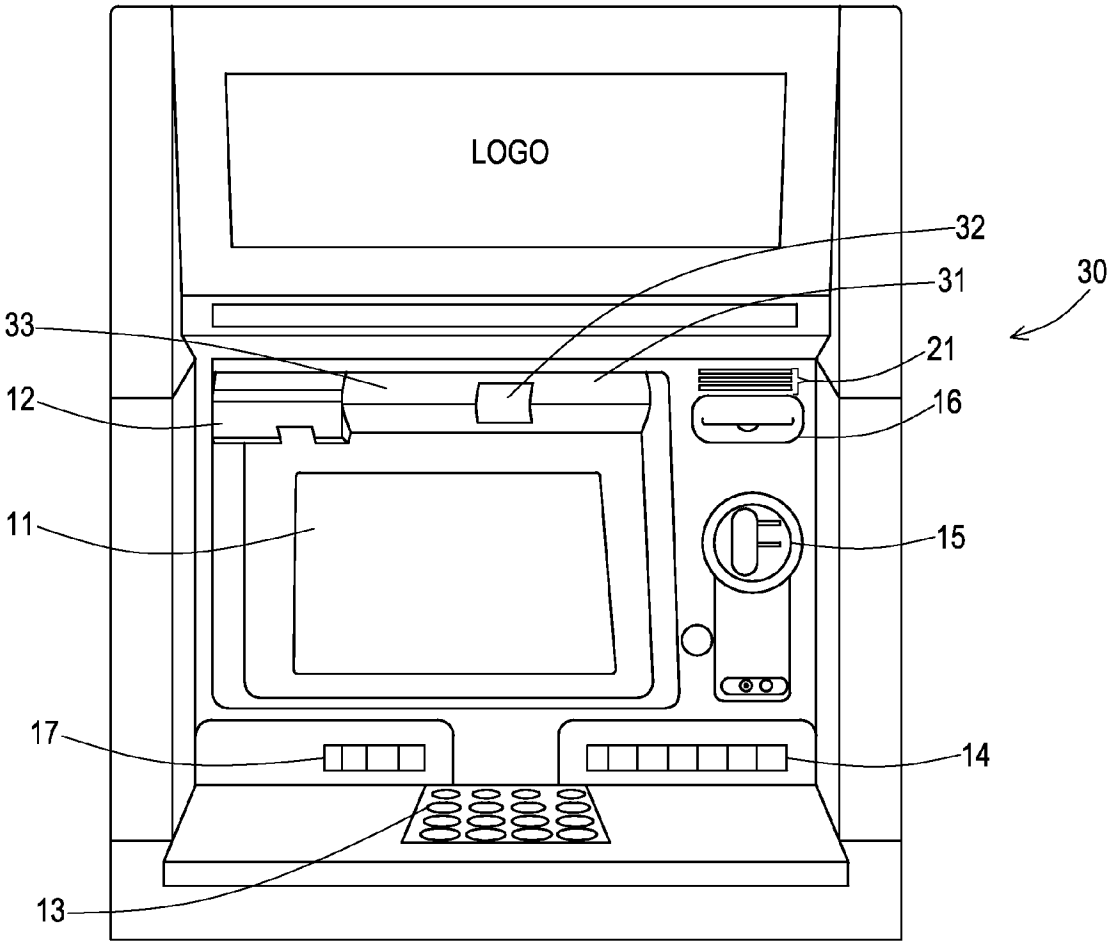
FIG. 2 depicts an exemplary automated teller machine (ATM) of the present invention.

The present invention is directed to automated teller machines (ATMs). FIG. 2 depicts an exemplary automated teller machine (ATM) 30 of the present invention. As shown in FIG. 2, exemplary ATM 30 comprises a screen display 11 viewable to a user (not shown) and positioned along an outer housing surface 22; a money-distributing component 17 positioned along outer housing surface 22; a camera lens cover 32 and an associated camera (not shown) positioned above screen display 11. As shown in FIG. 2, exemplary ATM 30 also comprises a check insert slot 12; a throat 20 (i.e., the portion of outer housing surface 22 extending from point 57 to point 59 in FIG. 7); speaker slots 21; and a cover member 31 extending a length above screen display 11 and between check insert slot 12 and throat 20.

As shown in FIG. 2, in some embodiments, exemplary ATM 30 may comprise cover member camera lens cover 32 and an associated camera (not shown) positioned within cover member 31. As shown in FIG. 2, cover member 31 comprises outer cover member surface 33 with cover member camera lens cover 32 positioned and surrounded by outer cover member surface 33.

Figure 3:
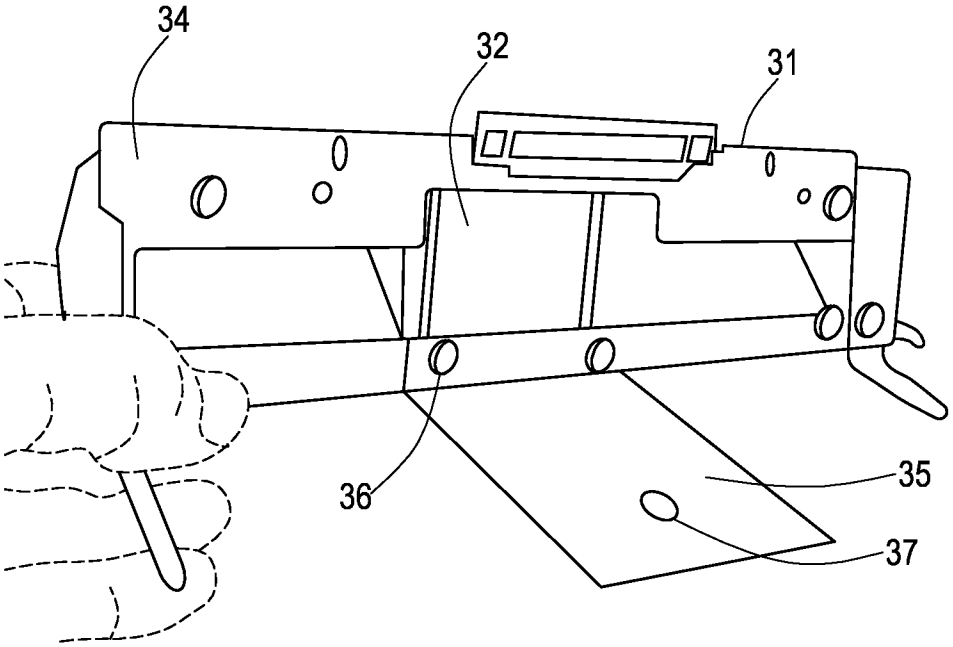
FIG. 3 depicts an exemplary cover member suitable for use in the exemplary ATM shown in FIG. 2.

FIG. 3 depicts a rear view of exemplary cover member 31 shown in FIG. 2. As shown in FIG. 3, exemplary cover member 31 comprises cover member camera lens cover 32, rear surface 34, camera bracket 35 attached to rear surface 34 via one or more fastening members (e.g., screws) 36, and a camera attachment member 37 (e.g., an opening for mounting a camera (not shown) via a screw).

Figure 1:
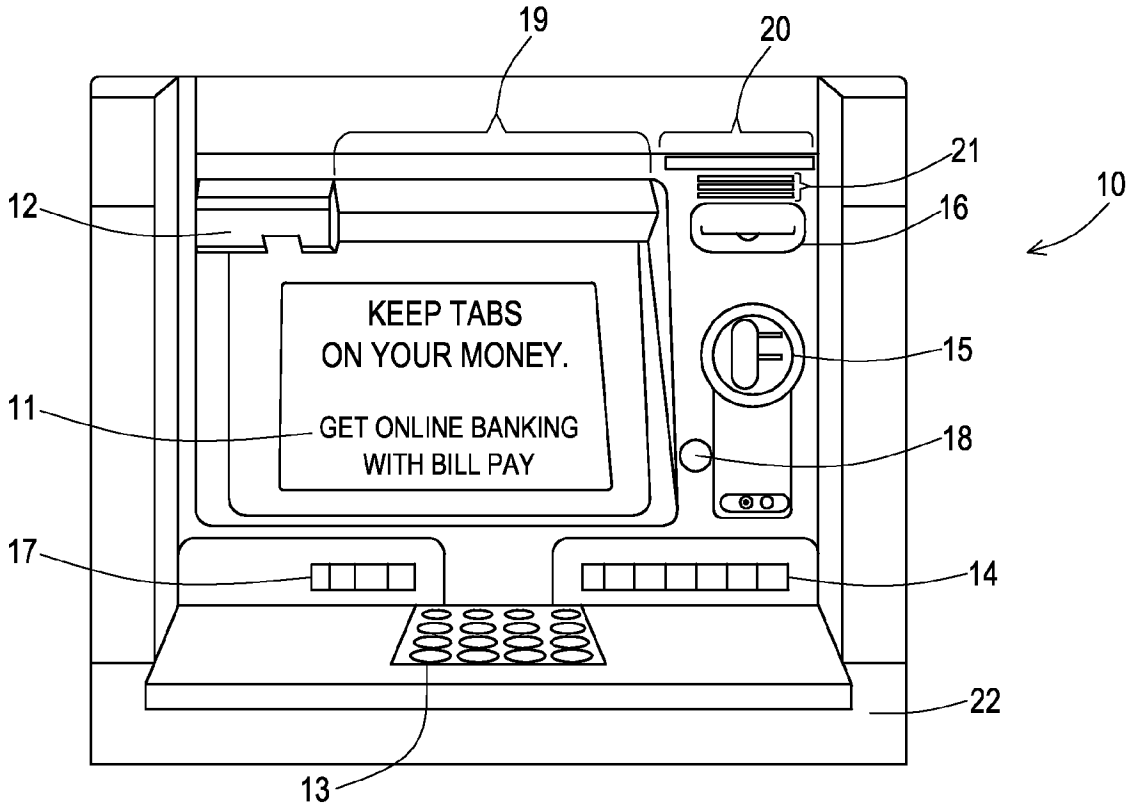
FIG. 1 (PRIOR ART)
FIG. 1 depicts an exemplary automated teller machine (ATM) of the prior art.
Figure 4:
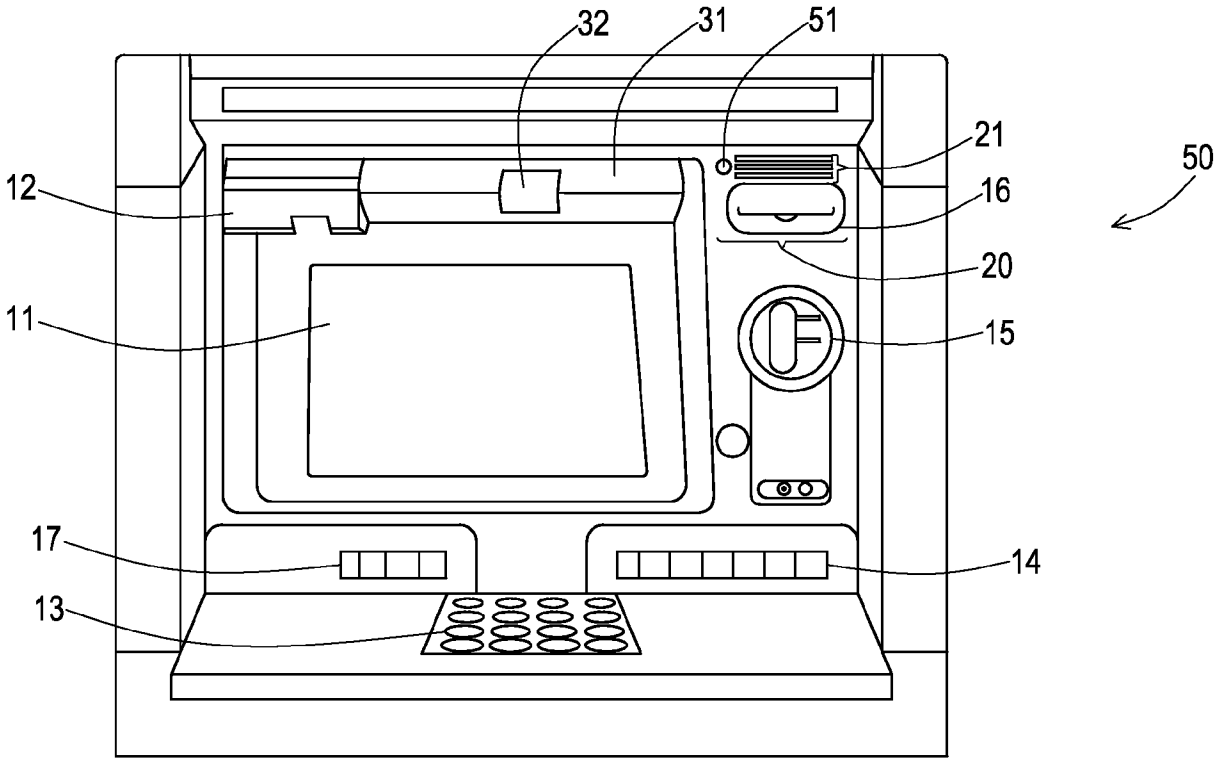
FIG. 4 depicts another exemplary automated teller machine (ATM) of the present invention.

FIG. 4 depicts another exemplary automated teller machine (ATM) 50 of the present invention. In this exemplary embodiment, camera lens cover 51 is positioned along throat 20 and between speaker slots 21 and cover member 31. It should be noted that, in this embodiment, cover member 31 may (1) be a solid sheet material (i.e., without cover member camera lens cover 32) or alternatively (2) comprise cover member camera lens cover 32. Further, it should be noted that camera lens cover 51 replaces camera lens cover 18 shown in FIG. 1 (i.e., although FIG. 4 shows a camera lens cover in the vicinity of camera lens cover 18 shown in FIG. 1, this embodiment does not comprise camera lens cover 18 shown in FIG. 1).

Figure 5:
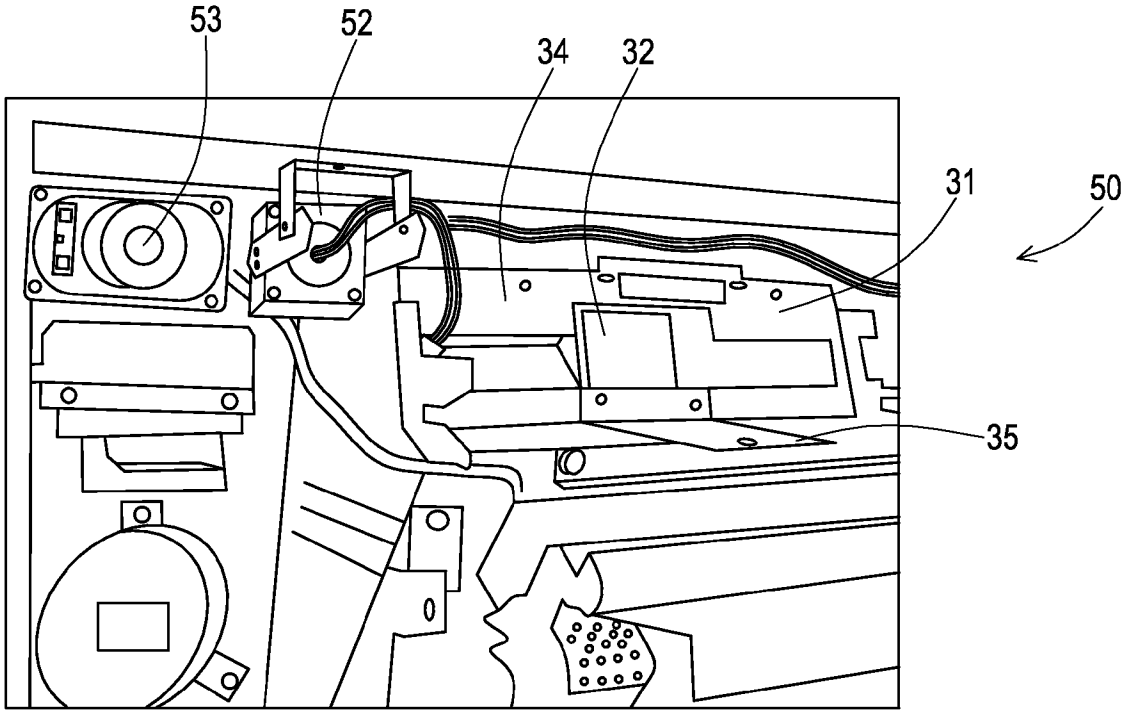
FIG. 5 depicts a view of the internal components of the exemplary ATM shown in FIG. 4 with a movable assembly moved to its maintenance position.

FIG. 5 depicts a view of the internal components of exemplary ATM 50 shown in FIG. 4 with a movable assembly (not shown; see FIG. 6) moved to its maintenance position. As shown in FIG. 5, camera 52 is positioned so as to position a camera lens (not shown) adjacent an inner surface (not shown) of camera lens cover 51. FIG. 5 also shows speaker 53 and cover member 31 positioned within exemplary ATM 50.

Figure 6:
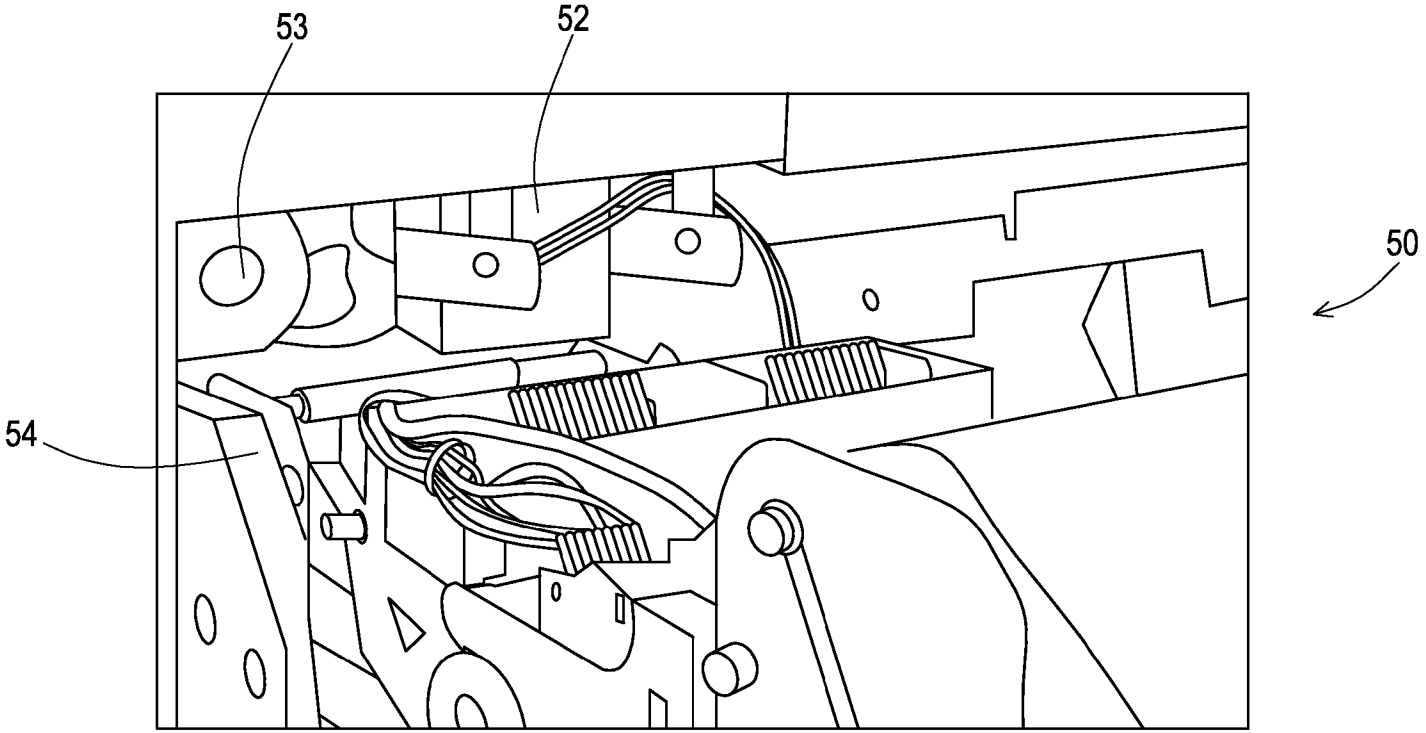
FIG. 6 depicts a view of the internal components of the exemplary ATM shown in FIG. 4 with the movable assembly moved to its operating position.

FIG. 6 depicts a view of the internal components of exemplary ATM 50 shown in FIG. 4 with movable assembly 54 moved to its operating position. As discussed above, in prior art ATM 10, a camera (not shown) would be mounted onto movable assembly 54 so that a camera lens (not shown) would be positioned adjacent an inner surface (not shown) of camera lens cover 18.

Figure 7:
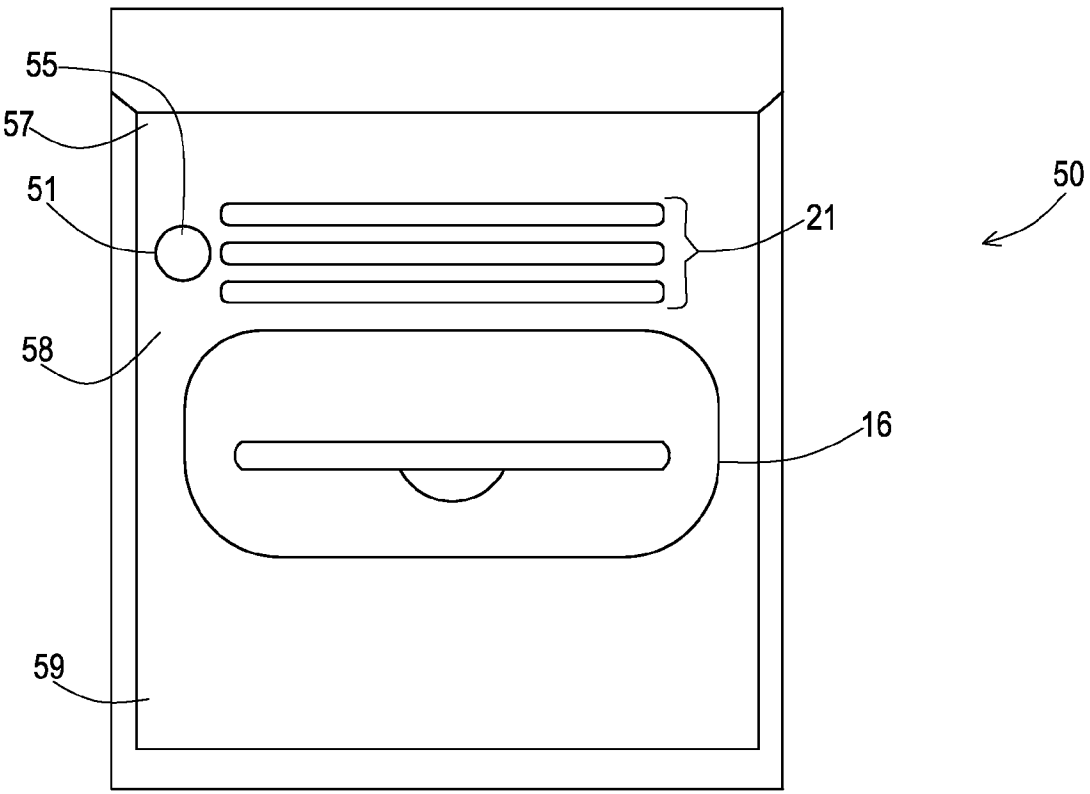
FIG. 7 depicts a close-up view of the camera location within the exemplary ATM shown in FIG. 4.

FIG. 7 depicts a close-up view of the camera lens cover 51 of exemplary ATM 50 shown in FIG. 4. As shown in FIG. 7, camera lens cover 51 comprises an outer surface 55. Typically, camera lens cover 51 is positioned along throat 20, between speaker slots 21 and cover member 31, and between points 57 and 58.

Figure 8:
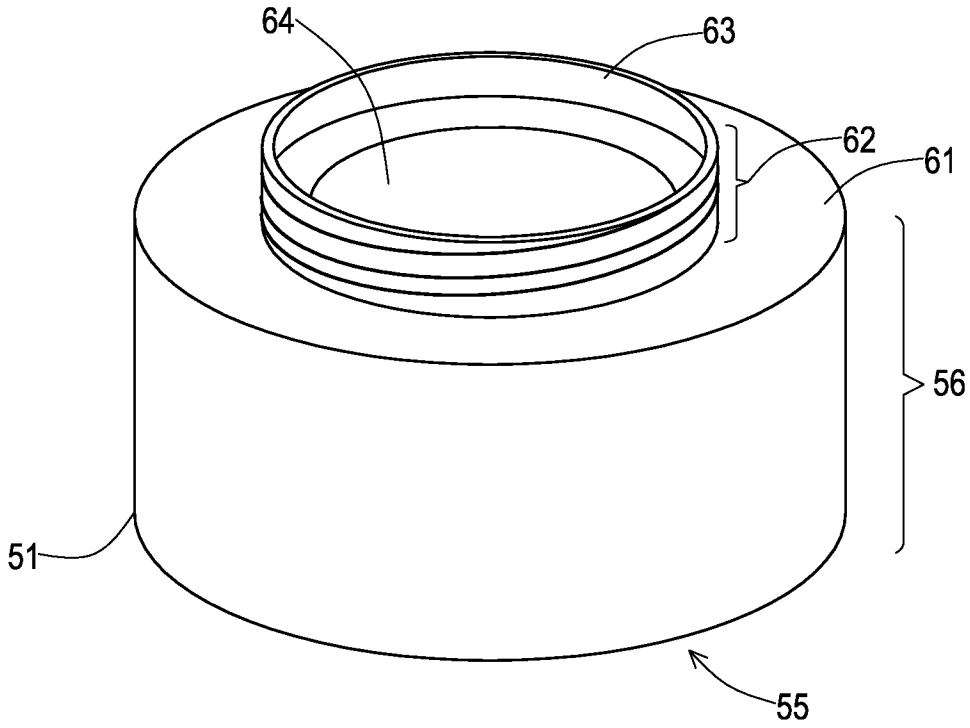
FIG. 8 depicts an exemplary camera lens cover suitable for use within the exemplary ATM shown in FIG. 4.

FIG. 8 depicts one version of exemplary camera lens cover 51 suitable for use within exemplary ATM 50 shown in FIG. 4. As shown in FIG. 8, camera lens cover 51 comprises outer surface 55 (i.e., the surface facing a user of the ATM), inner surface 64, outer periphery 56, a lens cover support member 61 attached to camera lens cover 51 along inner surface 64, an opening 63 through lens cover support member 61, and threads 62 positioned along lens cover support member 61. Although not shown in the figures, exemplary ATM 50 comprises corresponding threads positioned therein so that camera lens cover 51 shown in FIG. 8 attaches to ATM 50 as shown in FIG. 4.

Figure 9:
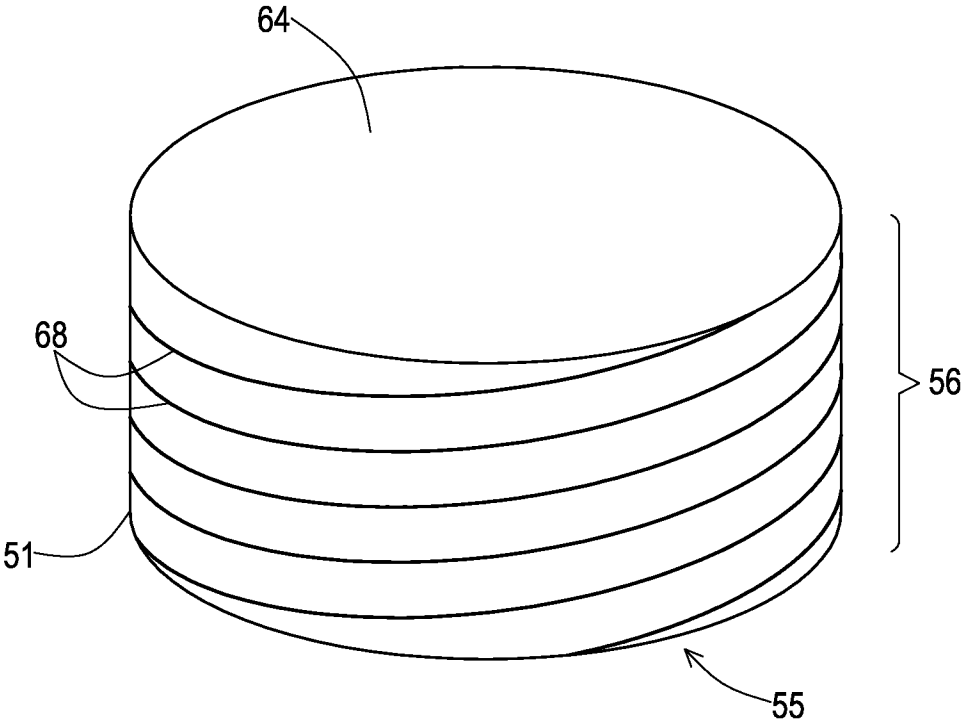
FIG. 9 depicts another exemplary camera lens cover suitable for use within the exemplary ATM shown in FIG. 4.

FIG. 9 depicts another version of exemplary camera lens cover 51 suitable for use within the exemplary ATM 50 shown in FIG. 4. In this embodiment, threads 68 are etched into an outer surface along outer periphery 56 of camera lens cover 51. Although not shown in the figures, exemplary ATM 50 comprises corresponding threads positioned therein so that camera lens cover 51 shown in FIG. 9 attaches to ATM 50 as shown in FIG. 4.

Desirably, exemplary camera lens cover 51 shown in FIGS. 8-9 comprises an outer surface 55 that is flush with outer housing surface 22.

Figure 10:
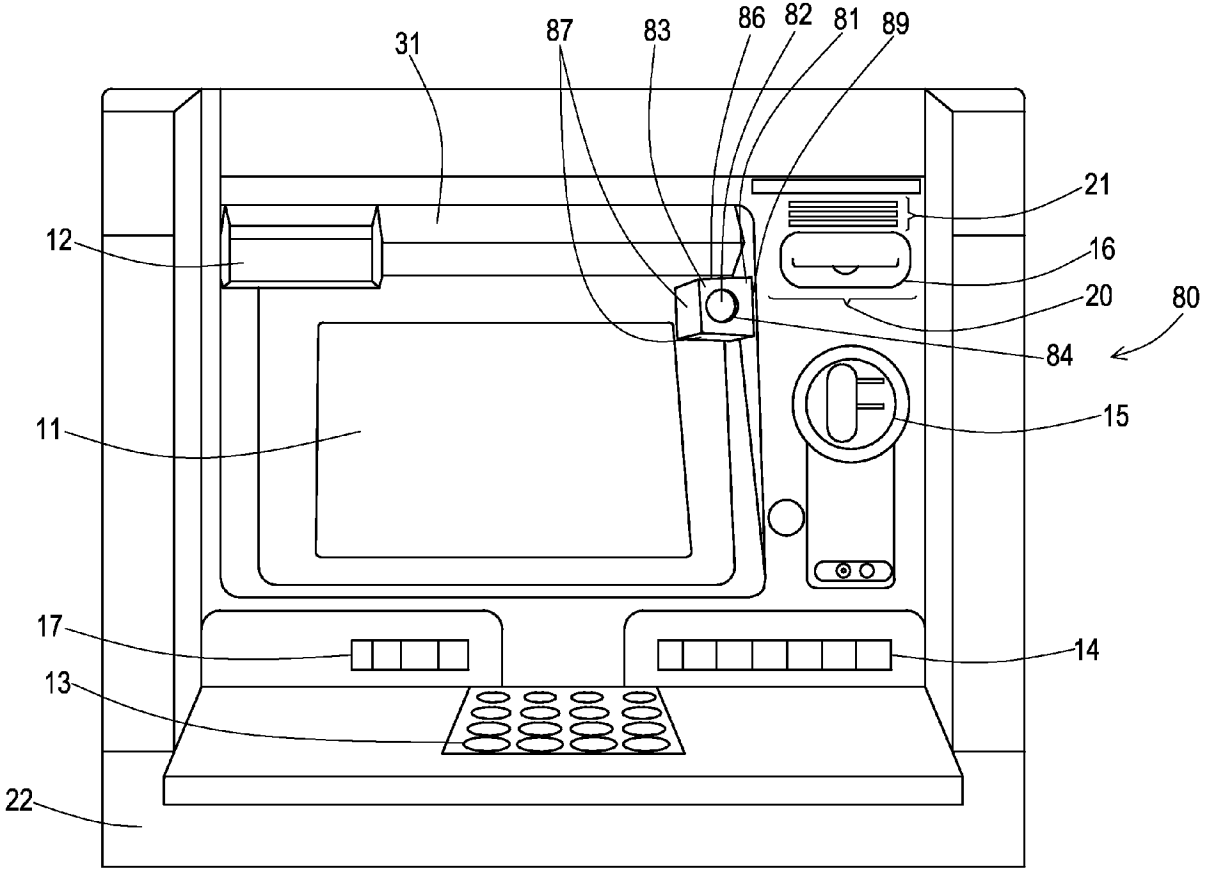
FIG. 10 depicts another exemplary automated teller machine (ATM) of the present invention.

FIG. 10 depicts another exemplary ATM 80 of the present invention. As shown in FIG. 10, exemplary ATM 80 comprises screen display 11 for viewing by a user (not shown) of exemplary ATM 80; check insert slot 12 for depositing checks; keypad 13 for inputting information for use by exemplary ATM 80; money-distributing component 14 for providing cash to the user; ATM card swiping component 15; receipt-providing slot 16 for providing a printed receipt for the user; deposit slot 17 for depositing cash or checks from the user; cover member 31 extending a length above screen display 11 and between check insert slot 12 and throat 20; speaker slots 21; and outer housing surface 22 extending around, between and surrounding the above-mentioned ATM components. Exemplary ATM 80 further comprises exemplary camera housing 81 with exemplary camera lens cover 82 positioned along a front surface 83 of exemplary camera housing 81.

Figure 11:
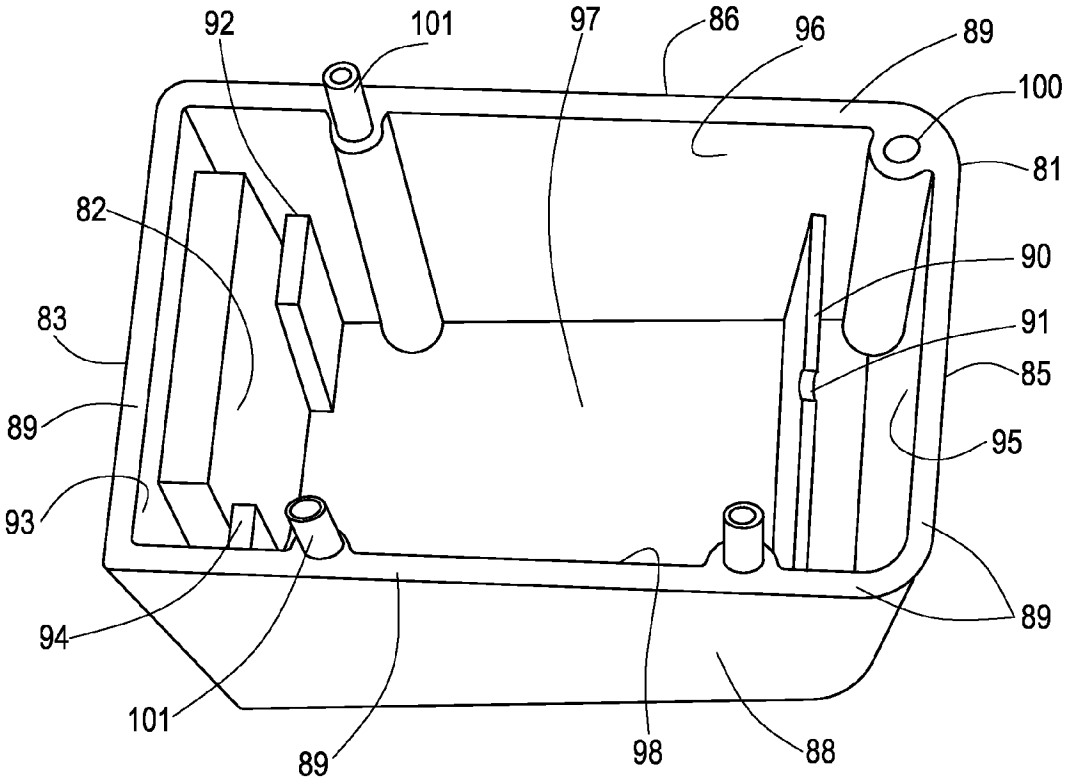
FIG. 11 depicts an exemplary camera housing used in the exemplary ATM shown in FIG. 10.

As shown in FIGS. 10-11, exemplary camera housing 81 comprises camera lens cover 82 positioned within externally mounted camera housing 81 attached to outer housing surface 22. Externally mounted camera housing 81 comprises front surface 83 having an aperture 84 therethrough, a rear surface 85 opposite front surface 83, three side surfaces 86, 87 and 88 extending from front surface 83 to rear surface 85, and a connecting edge 89 extending along front surface 83, rear surface 85 and two of the three side surfaces, namely, side surfaces 86 and 88.

As further shown in FIG. 11, exemplary camera housing 81 also comprises an intermediate wall 90 extending perpendicular to connecting edge 89 and parallel with front surface 83. Intermediate wall 90 extends from upper inner side wall surface 96 to lower inner side wall surface 98, and from vertically-extending inner side wall surface 97 towards connecting edge 89 (i.e., typically about ⅔ to about ¾ of a distance between vertically-extending inner side wall surface 97 and connecting edge 89). Intermediate wall 90 is spaced from rear surface 95 and front inner surface 93, but is closer to rear surface 95 than front inner surface 93. Intermediate wall 90 further comprises a camera mounting slot 91 therein.

As shown in FIGS. 10-11, camera lens cover 82 is removably positioned within exemplary camera housing 81 so as to cover aperture 84 within front surface 83. Camera lens cover 82 slides within camera lens cover channels 92 and 94 on opposite side of aperture 84. Camera lens cover channels 92 and 94 are typically attached to a front inner surface 93 of exemplary camera housing 81 (e.g., via a single injection molding step).

As further shown in FIG. 11, exemplary upper side surface 86 of the three side surfaces 86, 87 and 88 has a length that is greater than a length of a lower side surface 88 of the three side surfaces. As further shown in FIG. 11, exemplary camera housing 81 may further comprise one or more holes 100 sized to house one or more attachment members 101 (e.g., screws 101). Attachment members 101 (e.g., screws 101) may be used to attach connecting edge 89 of exemplary camera housing 81 onto outer housing surface 22 of exemplary ATM 80 (as shown in FIG. 10).

Figure 12:
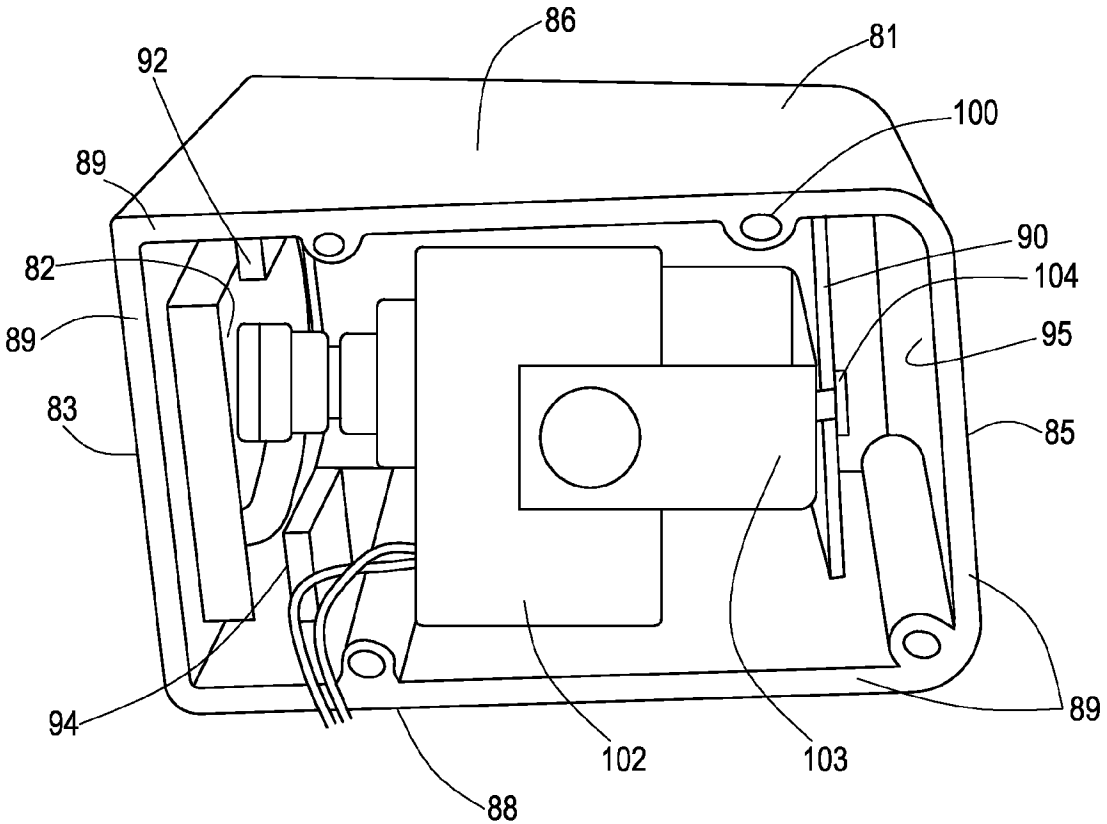
FIG. 12 depicts the exemplary cover member shown in FIG. 11 with a camera positioned therein.

As shown in FIG. 12, exemplary camera housing 81 is sized to house a camera 102 positioned therein. A rear portion 103 of camera 102 attaches to slot 91 of intermediate wall 90 via camera attachment member 104 (e.g., bolt 104) along an opposite side of intermediate wall 90 from camera 102.

As discussed above and as shown in FIGS. 2-12, ATMs and ATM components of the present invention provide one or more features that enable (i) camera recording of one or more views of an ATM user; and/or (ii) ease of ATM manufacturing and/or maintenance. In addition, the ATMs and ATM components of the present invention provide may comprise (or consist essentially of, or consist of) one or more of the following features:

(1) an ATM with one or more camera lens covers positioned along an upper portion of an ATM screen display or above the ATM screen display;

(2) an ATM with one or more camera lens covers positioned along an upper portion of an ATM screen display (e.g., the upper portion being an upper half, and upper third, or an upper quarter of the ATM screen display);

(3) an ATM with one or more camera lens covers positioned above the ATM screen display;

(4) an ATM with one or more camera lens covers positioned above the ATM screen display, wherein one of the camera lens covers is positioned within an outer periphery of a cover member;

(5) an ATM with one or more camera lens covers positioned above the ATM screen display, wherein one of the camera lens covers is positioned within an outer periphery of a rectangular-shaped cover member;

(6) an ATM with one or more camera lens covers positioned above the ATM screen display, wherein one of the camera lens covers has a circular shape and is removable from a front side of an outer housing surface of the ATM;

(7) an ATM with one or more camera lens covers positioned above the ATM screen display, wherein one of the camera lens covers has a circular shape, is removable from a front side of an outer housing surface of the ATM, and comprises threads along an outer periphery of the camera lens cover;

(8) an ATM with one or more camera lens covers positioned above the ATM screen display, wherein one of the camera lens covers has a circular shape, is removable from a front side of an outer housing surface of the ATM, and comprises threads along an outer periphery of the camera lens cover, wherein the threads are positioned along an outer periphery of a lens cover support member attached to the camera lens cover;

(9) an ATM with one or more camera lens covers positioned above the ATM screen display, wherein one of the camera lens covers has a circular shape, is removable from a front side of an outer housing surface of the ATM, and comprises threads along an outer periphery of the camera lens cover, wherein the threads are etched into an outer surface of the camera lens cover;

(10) an ATM with one or more camera lens covers positioned above the ATM screen display, wherein one of the camera lens covers has a circular shape, is removable from a front side of an outer housing surface of the ATM, and comprises threads along an outer periphery of the camera lens cover, wherein an outer surface of the camera lens cover is flush with an outer housing surface of the ATM;

(11) an ATM with one or more camera lens covers positioned along an upper portion of an ATM screen display or above the ATM screen display, wherein one camera lens cover is positioned within an externally mounted camera housing attached to an outer housing surface of the ATM;

(12) an ATM with one or more camera lens covers positioned along an upper portion of an ATM screen display or above the ATM screen display, wherein one camera lens cover is positioned within an externally mounted camera housing attached to an outer housing surface of the ATM, wherein the externally mounted camera housing comprises a front surface having an aperture therethrough, a rear surface opposite the front surface, at least one side surface (e.g., one, two, three or four side surfaces) extending from the front surface to the rear surface, and a connecting edge extending along the front surface, the rear surface and the at least one side surface;

(13) an ATM with one or more camera lens covers positioned along an upper portion of an ATM screen display or above the ATM screen display, wherein one camera lens cover is positioned within an externally mounted camera housing attached to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein;

(14) an ATM with one or more camera lens covers positioned along an upper portion of an ATM screen display or above the ATM screen display, wherein one camera lens cover is positioned within an externally mounted camera housing attached to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein; wherein an upper side surface of the at least one side surfaces has a length that is greater than a length of a lower side surface of the at least one side surfaces;

(15) an ATM with one or more camera lens covers positioned along an upper portion of an ATM screen display or above the ATM screen display, wherein one camera lens cover is positioned within an externally mounted camera housing attached to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein; and a camera mounted within the externally mounted camera housing;

(16) an ATM camera lens cover positioned within an outer periphery of an ATM cover member;

(17) an ATM camera lens cover positionable above an ATM screen display, wherein the ATM camera lens cover is positioned within an outer periphery of a rectangular-shaped ATM cover member;

(18) an ATM camera lens cover positionable above an ATM screen display, wherein the ATM camera lens cover has a circular shape and is insertable and removable from a front side of an outer housing surface of the ATM;

(19) an ATM camera lens cover positionable above an ATM screen display, wherein the ATM camera lens cover has a circular shape, is insertable and removable from a front side of an outer housing surface of the ATM, and comprises threads along an outer periphery of the camera lens cover;

(20) an ATM camera lens cover positionable above an ATM screen display, wherein the ATM camera lens cover has a circular shape, is insertable and removable from a front side of an outer housing surface of the ATM, and comprises threads along an outer periphery of the camera lens cover, wherein the threads are positioned along an outer periphery of a lens cover support member attached to the camera lens cover;

(21) an ATM camera lens cover positionable above an ATM screen display, wherein the ATM camera lens cover has a circular shape, is insertable and removable from a front side of an outer housing surface of the ATM, and comprises threads along an outer periphery of the camera lens cover, wherein the threads are etched into an outer surface of the camera lens cover;

(22) an ATM camera lens cover positionable above an ATM screen display, wherein the ATM camera lens cover has a circular shape, is insertable and removable from a front side of an outer housing surface of the ATM, and comprises threads along an outer periphery of the camera lens cover, wherein an outer surface of the camera lens cover is flush with an outer housing surface of the ATM;

(23) an ATM camera lens cover positionable along an upper portion of an ATM screen display or above the ATM screen display, wherein the camera lens cover is positioned within an externally mounted camera housing attachable to an outer housing surface of the ATM;

(24) an ATM camera lens cover positionable along an upper portion of an ATM screen display or above the ATM screen display, wherein the camera lens cover is positioned within an externally mounted camera housing attachable to an outer housing surface of the ATM, wherein the externally mounted camera housing comprises a front surface having an aperture therethrough, a rear surface opposite the front surface, at least one side surface (e.g., one, two, three or four side surfaces) extending from the front surface to the rear surface, and a connecting edge extending along the front surface, the rear surface and the at least one side surface;

(25) an ATM camera lens cover positionable along an upper portion of an ATM screen display or above the ATM screen display, wherein the camera lens cover is positioned within an externally mounted camera housing attachable to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein;

(26) an ATM camera lens cover positionable along an upper portion of an ATM screen display or above the ATM screen display, wherein the camera lens cover is positioned within an externally mounted camera housing attachable to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein; wherein an upper side surface of the at least one side surfaces has a length that is greater than a length of a lower side surface of the at least one side surfaces; and/or

(27) an ATM camera lens cover positionable along an upper portion of an ATM screen display or above the ATM screen display, wherein the camera lens cover is positioned within an externally mounted camera housing attachable to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein; and a camera mounted within the externally mounted camera housing.

The present invention is further directed to methods of making and using any of the disclosed ATMs and ATM components. In one exemplary embodiment, the method of making an ATM component comprises forming an externally mountable camera housing suitable for use with an ATM, wherein the externally mountable camera housing comprises a front surface having an aperture therethrough; a rear surface opposite the front surface; at least one side surface extending from the front surface to the rear surface; a connecting edge extending along the front surface, the rear surface and the at least one side surface, the connecting edge being configured to attach to an outer housing surface of an ATM; and an intermediate wall extending perpendicular to the connecting edge and parallel with the front surface, wherein the intermediate wall comprises a camera mounting slot therein. In some embodiments, the forming step comprises an injection molding step, and the resulting externally mountable camera housing comprises three side surfaces, and an upper side surface of the three side surfaces has a length that is greater than a length of a lower side surface of the three side surfaces.

The forming step may also comprise, for example, a single injection molding step, wherein the resulting externally mountable camera housing further comprises camera lens cover channels along opposite sides of the aperture. In this embodiment, the method of making an ATM component may further comprise forming a camera lens cover, wherein the camera lens cover comprises a removable camera lens cover sized to be removably positioned within the camera lens cover channels of the externally mountable camera housing.

In another exemplary embodiment, the method of making an ATM component comprises forming a camera lens cover that is positionable along an outer housing surface of an ATM, wherein the camera lens cover is removable from the outer housing surface of the ATM from a front side of the outer housing surface of the ATM. In some embodiments, the forming step comprises thermoforming a camera lens cover; and machining threads along an outer periphery of the camera lens cover, wherein the threads are engagable with another set of threads within an outer housing surface of the ATM.

Method of making and/or using an ATM or ATM component of the present invention may include one or more additional steps. Suitable additional method steps for making and/or using an ATM or ATM component of the present invention include, but are not limited to:

(1) forming an ATM with one or more camera lens covers positioned along an upper portion of an ATM screen display or above the ATM screen display (e.g., assembling various components to form such an ATM);

(2) forming an ATM with one or more camera lens covers positioned along an upper portion of an ATM screen display (e.g., the upper portion being an upper half, and upper third, or an upper quarter of the ATM screen display) (e.g., assembling various components to form such an ATM);

(3) forming an ATM with one or more camera lens covers positioned above the ATM screen display (e.g., assembling various components to form such an ATM);

(4) forming an ATM with one or more camera lens covers positioned above the ATM screen display, wherein one of the camera lens covers is positioned within an outer periphery of a cover member (e.g., assembling various components to form an ATM such as exemplary ATM 30 shown in FIG. 2);

(5) forming an ATM with one or more camera lens covers positioned above the ATM screen display, wherein one of the camera lens covers is positioned within an outer periphery of a rectangular-shaped cover member (e.g., assembling various components to form an ATM such as exemplary ATM 30 shown in FIG. 2);

(6) forming an ATM with one or more camera lens covers positioned above the ATM screen display, wherein one of the camera lens covers has a circular shape and is removable from a front side of an outer housing surface of the ATM (e.g., assembling various components to form an ATM such as exemplary ATM 50 shown in FIG. 4);

(7) forming an ATM with one or more camera lens covers positioned above the ATM screen display, wherein one of the camera lens covers has a circular shape, is removable from a front side of an outer housing surface of the ATM, and comprises threads along an outer periphery of the camera lens cover (e.g., assembling various components to form an ATM such as exemplary ATM 50 shown in FIG. 4);

(8) forming an ATM with one or more camera lens covers positioned above the ATM screen display, wherein one of the camera lens covers has a circular shape, is removable from a front side of an outer housing surface of the ATM, and comprises threads along an outer periphery of the camera lens cover, wherein the threads are positioned along an outer periphery of a lens cover support member attached to the camera lens cover (e.g., assembling various components, including the component shown in FIG. 8, to form an ATM such as exemplary ATM 50 shown in FIG. 4);

(9) forming an ATM with one or more camera lens covers positioned above the ATM screen display, wherein one of the camera lens covers has a circular shape, is removable from a front side of an outer housing surface of the ATM, and comprises threads along an outer periphery of the camera lens cover, wherein the threads are etched into an outer surface of the camera lens cover (e.g., assembling various components, including the component shown in FIG. 9, to form an ATM such as exemplary ATM 50 shown in FIG. 4);

(10) forming an ATM with one or more camera lens covers positioned above the ATM screen display, wherein one of the camera lens covers has a circular shape, is removable from a front side of an outer housing surface of the ATM, and comprises threads along an outer periphery of the camera lens cover, wherein an outer surface of the camera lens cover is flush with an outer housing surface of the ATM (e.g., assembling various components, including one of the components shown in FIGS. 8-9, to form an ATM such as exemplary ATM 50 shown in FIG. 4);

(11) forming an ATM with one or more camera lens covers positioned along an upper portion of an ATM screen display or above the ATM screen display, wherein one camera lens cover is positioned within an externally mounted camera housing attached to an outer housing surface of the ATM (e.g., assembling various components, including the externally mountable camera housing shown in FIG. 11, to form an ATM such as exemplary ATM 80 shown in FIG. 10);

(12) forming an ATM with one or more camera lens covers positioned along an upper portion of an ATM screen display or above the ATM screen display, wherein one camera lens cover is positioned within an externally mounted camera housing attached to an outer housing surface of the ATM, wherein the externally mounted camera housing comprises a front surface having an aperture therethrough, a rear surface opposite the front surface, at least one side surface (e.g., one, two, three or four side surfaces) extending from the front surface to the rear surface, and a connecting edge extending along the front surface, the rear surface and the at least one side surface (e.g., assembling various components, including the externally mountable camera housing shown in FIG. 11, to form an ATM such as exemplary ATM 80 shown in FIG. 10);

(13) forming an ATM with one or more camera lens covers positioned along an upper portion of an ATM screen display or above the ATM screen display, wherein one camera lens cover is positioned within an externally mounted camera housing attached to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein (e.g., assembling various components, including the externally mountable camera housing shown in FIG. 11, to form an ATM such as exemplary ATM 80 shown in FIG. 10);

(14) forming an ATM with one or more camera lens covers positioned along an upper portion of an ATM screen display or above the ATM screen display, wherein one camera lens cover is positioned within an externally mounted camera housing attached to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein; wherein an upper side surface of the at least one side surfaces has a length that is greater than a length of a lower side surface of the at least one side surfaces (e.g., assembling various components, including the externally mountable camera housing shown in FIG. 11, to form an ATM such as exemplary ATM 80 shown in FIG. 10);

(15) forming an ATM with one or more camera lens covers positioned along an upper portion of an ATM screen display or above the ATM screen display, wherein one camera lens cover is positioned within an externally mounted camera housing attached to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein; and a camera mounted within the externally mounted camera housing (e.g., assembling various components, including the externally mountable camera housing shown in FIG. 11, to form an ATM such as exemplary ATM 80 shown in FIG. 10);

(16) forming an ATM camera lens cover positioned within an outer periphery of an ATM cover member (e.g., thermoforming cover member 31, separately forming camera lens cover 32, and assembling cover member 31 with camera lens cover 32, both of which are shown in FIG. 2);

(17) forming an ATM camera lens cover positionable above an ATM screen display, wherein the ATM camera lens cover is positioned within an outer periphery of a rectangular-shaped ATM cover member (e.g., thermoforming cover member 31, separately forming camera lens cover 32, and assembling cover member 31 with camera lens cover 32, both of which are shown in FIG. 2);

(18) forming an ATM camera lens cover positionable above an ATM screen display, wherein the ATM camera lens cover has a circular shape and is insertable and removable from a front side of an outer housing surface of the ATM (e.g., thermoforming camera lens cover 51 shown in FIGS. 4 and 8-9);

(19) forming an ATM camera lens cover positionable above an ATM screen display, wherein the ATM camera lens cover has a circular shape, is insertable and removable from a front side of an outer housing surface of the ATM, and comprises threads along an outer periphery of the camera lens cover (e.g., thermoforming camera lens cover 51, and machining threads along an outer periphery thereof, such as in camera lens cover 51 shown in FIGS. 4 and 8-9);

(20) forming an ATM camera lens cover positionable above an ATM screen display, wherein the ATM camera lens cover has a circular shape, is insertable and removable from a front side of an outer housing surface of the ATM, and comprises threads along an outer periphery of the camera lens cover, wherein the threads are positioned along an outer periphery of a lens cover support member attached to the camera lens cover (e.g., thermoforming camera lens cover 51, thermoforming a lens cover support member, and machining threads along an outer periphery of the lens cover support member, such as in camera lens cover 51 shown in FIG. 8);

(21) forming an ATM camera lens cover positionable above an ATM screen display, wherein the ATM camera lens cover has a circular shape, is insertable and removable from a front side of an outer housing surface of the ATM, and comprises threads along an outer periphery of the camera lens cover, wherein the threads are etched into an outer surface of the camera lens cover (e.g., thermoforming camera lens cover 51, and machining threads along an outer periphery thereof, such as in camera lens cover 51 shown in FIG. 9);

(22) forming an ATM camera lens cover positionable above an ATM screen display, wherein the ATM camera lens cover has a circular shape, is insertable and removable from a front side of an outer housing surface of the ATM, and comprises threads along an outer periphery of the camera lens cover, wherein an outer surface of the camera lens cover is flush with an outer housing surface of the ATM (e.g., thermoforming camera lens cover 51, optionally thermoforming a lens cover support member, and machining threads along an outer periphery of the lens cover support member or the camera lens cover, such as in camera lens covers 51 shown in FIGS. 8-9);

(23) forming an ATM camera lens cover positionable along an upper portion of an ATM screen display or above the ATM screen display, wherein the camera lens cover is a removable camera lens cover positionable within an externally mounted camera housing that is attachable to an outer housing surface of the ATM (e.g., thermoforming camera lens cover 82 shown in FIGS. 10-11);

(24) forming an externally mounted camera housing that is attachable to an outer housing surface of the ATM, wherein the externally mounted camera housing comprises a front surface having an aperture therethrough, a rear surface opposite the front surface, at least one side surface (e.g., one, two, three or four side surfaces) extending from the front surface to the rear surface, and a connecting edge extending along the front surface, the rear surface and the at least one side surface (e.g., thermoforming externally mounted camera housing 81 shown in FIGS. 10-12);

(25) forming an externally mounted camera housing attachable to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein (e.g., thermoforming externally mounted camera housing 81 shown in FIGS. 10-12);

(26) forming an externally mounted camera housing attachable to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein; wherein an upper side surface of the at least one side surfaces has a length that is greater than a length of a lower side surface of the at least one side surfaces (e.g., thermoforming externally mounted camera housing 81 shown in FIGS. 10-12); and/or

(27) forming an externally mounted camera housing attachable to an outer housing surface of the ATM, wherein the externally mounted camera housing comprises a front surface having an aperture therethrough; a rear surface opposite the front surface; at least one side surface (e.g., one, two, three or four side surfaces) extending from the front surface to the rear surface; a connecting edge extending along the front surface, the rear surface and the at least one side surface; and an intermediate wall extending perpendicular to the connecting edge and parallel with the front surface, the intermediate wall comprising a camera mounting slot therein; and positioning a camera within the externally mounted camera housing (e.g., thermoforming externally mounted camera housing 81 shown in FIG. 12).

It should be understood that any of the above mentioned thermoforming steps and/or forming steps may be any conventional step. For example, the thermoforming step may comprise any molding step, such as an injection molding step. Other conventional processes that may be used to form the ATM and ATM components of the present invention may include, but are not limited to, a cutting step; an abrading step (e.g., to form a smooth surface); a machining step (e.g., any step to remove material from an object); and one or more assembling steps (e.g., combining and/or attaching one of more components with one another).

Further, it should be understood that any conventional materials may be used to form the ATM components of the present invention. For example, polymeric materials, metal materials, and combinations thereof may be used to form one or more ATM components of the present invention.

In addition, it should be understood that although the above-described ATMs, ATM components/features, and methods are described as "comprising" one or more components or steps, the above-described ATMs, ATM components/features, and methods may "comprise," "consists of," or "consist essentially of" the above-described components or steps of the ATMs, ATM components/features, and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, an ATM, ATM component, and/or method that "comprises" a list of elements (e.g., components or steps) is not necessarily limited to only those elements (or components or steps), but may include other elements (or components or steps) not expressly listed or inherent to the ATM, ATM component, and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define an ATM, ATM component, and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described ATMs, ATM components, and/or methods may comprise, consist essentially of, or consist of any of the herein-described components and features, as shown in the figures with or without any feature(s) not shown in the figures. In other words, in some embodiments, the ATMs or ATM components of the present invention do not have any additional features other than those shown in the figures, and such additional features, not shown in the figures, are specifically excluded from the ATMs or ATM components. In other embodiments, the ATMs or ATM components of the present invention do have one or more additional features that are not shown in the figures.

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

Example 1

Exemplary ATMs and ATM components of the present invention, such as those detailed in FIGS. 1-12 and described above, were prepared and utilized to make one or more financial transactions.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. An automated teller machine comprising:

a housing structure comprising an outer housing surface;

a screen display viewable to a user and positioned along said outer housing surface;

a keypad for inputting one or more letters or numbers and positioned along said outer housing surface;

a money-distributing component positioned along said outer housing surface;

a check insert slot positioned along said outer housing surface;

a throat positioned along said outer housing surface;

speaker slots positioned along said outer housing surface;

a removable cover member positioned above and extending a length above said screen display between said check insert slot and said throat; and at least one camera lens cover positioned along said outer housing surface, wherein said at least one camera lens cover is (i) positioned along an upper portion of said screen display or (ii) within said removable cover member positioned above said screen display.

2. The automated teller machine of claim 1, wherein said at least one camera lens cover is within said removable cover member.

3. The automated teller machine of claim 1, wherein said at least one camera lens cover is positioned along said throat and between said speaker slots and said removable cover member.

4. The automated teller machine of claim 1, wherein said at least one camera lens cover is positioned within a detachable externally mounted camera housing attached to said outer housing surface.

5. The automated teller machine of claim 4, wherein said detachable externally mounted camera housing comprises a front surface having an aperture therethrough, a rear surface opposite said front surface, and three side surfaces extending from said front surface to said rear surface, and a connecting edge extending along said front surface, said rear surface and two of said three side surfaces.

6. The automated teller machine of claim 5, wherein said detachable externally mounted camera housing further comprises an intermediate wall extending perpendicular to said connecting edge and parallel with said front surface, said intermediate wall comprising a camera mounting slot therein.

7. The automated teller machine of claim 6, wherein an upper side surface of said three side surfaces has a length that is greater than a length of a lower side surface of said three side surfaces.

8. The automated teller machine of claim 7, wherein said detachable externally mounted camera housing further comprises camera lens cover channels along opposite sides of said aperture, and said at least one camera lens cover comprises a removable camera lens cover positionable within said camera lens cover channels.

9. The automated teller machine of claim 8, further comprising a camera mounted within said detachable externally mounted camera housing.

10. An automated teller machine comprising:

a housing structure comprising at least one outer housing surface; and at least one camera lens cover positioned along said at least one outer housing surface, wherein said at least one camera lens cover comprises threads along an outer periphery of said at least one camera lens cover.

11. The automated teller machine of claim 10, wherein said threads are positioned along an outer periphery of a lens cover support member attached to said at least one camera lens cover.

12. The automated teller machine of claim 10, wherein said threads are etched into an outer surface of said at least one camera lens cover.

13. The automated teller machine of claim 10, wherein an outer surface of said at least one camera lens cover is flush with said at least one outer housing surface.

14. The automated teller machine of claim 10, further comprising:

a screen display viewable to a user and positioned along said at least one outer housing surface;

a keypad for inputting one or more letters or numbers and positioned along said at least one outer housing surface; and a money-distributing component positioned along said at least one outer housing surface;

wherein said at least one camera lens cover is within a removable cover member extending a length directly above said screen display and an associated camera is positioned above said screen display and behind said at least one camera lens cover within said removable cover member.

15. An externally mountable camera housing suitable for use with an automated teller machine (ATM), said externally mountable camera housing comprising:

a front surface having an aperture therethrough;

a rear surface opposite the front surface;

at least one side surface extending from the front surface to the rear surface;

a connecting edge extending along the front surface, the rear surface and the at least one side surface, the connecting edge being configured to attach to an outer housing surface of an ATM;

an intermediate wall extending perpendicular to the connecting edge and parallel with the front surface, wherein the intermediate wall comprises a camera mounting slot therein;

and a removable camera lens cover sized to be positionable within said housing so as to cover said aperture.

16. The externally mountable camera housing of claim 15, further comprising camera lens cover channels along opposite sides of said aperture; said removable camera lens cover being sized to be positionable between said camera lens cover channels.

17. The externally mountable camera housing of claim 16 attached to and positioned along the outer housing surface of the ATM.

18. The externally mountable camera housing of claim 15, further comprising a camera positioned within said housing and attached to said intermediate wall via said camera mounting slot.

19. The externally mountable camera housing of claim 18 attached to and positioned along the outer housing surface of the ATM.

20. The externally mountable camera housing of claim 15 attached to and positioned along the outer housing surface of the ATM.

* * * * *